United States Patent [19]

Limque et al.

[11] 4,368,037

[45] Jan. 11, 1983

[54] CONVEYOR ARRANGEMENT FOR A CONTINUOUS OVEN

[75] Inventors: Ferdinand Limque, Berg en dal, Netherlands; Hans Bertrand, Goch, Fed. Rep. of Germany

[73] Assignee: Ipsen Industries International GmbH, Kleve, Fed. Rep. of Germany

[21] Appl. No.: 260,271

[22] Filed: May 6, 1981

[30] Foreign Application Priority Data

May 10, 1980 [DE] Fed. Rep. of Germany ..... 3017941

[51] Int. Cl.[3] ..... F27D 3/00

[52] U.S. Cl. ..... 432/239; 104/93; 104/168; 105/29 R; 105/150; 198/473

[58] Field of Search ..... 432/243, 244, 239; 198/472, 473; 104/93, 89, 165, 168; 105/29 R, 150

[56] References Cited

U.S. PATENT DOCUMENTS

| | | | |
|---|---|---|---|
| 1,254,204 | 1/1918 | Connor | 198/472 |
| 1,900,903 | 3/1933 | Bennington | 432/243 |
| 3,609,295 | 9/1971 | Bielefeldt | 219/388 |
| 3,854,419 | 12/1974 | Cocroft | 104/93 |

FOREIGN PATENT DOCUMENTS

| | | | |
|---|---|---|---|
| 693331 | 11/1930 | France | 104/168 |

*Primary Examiner*—John J. Camby

*Attorney, Agent, or Firm*—Leydig, Voit, Osann, Mayer & Holt, Ltd.

[57] ABSTRACT

A conveyor arrangement incorporated in a continuous oven comprises a plurality of support rails, one mounted in each oven chamber, and load-carrying frames suspended from the rails and arranged to move through the chambers. Each chamber has at least one drive pinion assembly comprising two pinions drivingly coupled by a chain drive, and each pinion can mesh with a rack to advance the load-carrying frames through the oven chamber. Each rack is secured to a respective load-carrying frame.

14 Claims, 4 Drawing Figures

CONVEYOR ARRANGEMENT FOR A CONTINUOUS OVEN

BACKGROUND OF THE INVENTION

This invention relates to an arrangement for conveying load-carrying frames through a continuous oven, for example, an aluminium soldering oven with several chambers arranged in series one after another. A typical oven is disclosed in U.S. Pat. No. 3,697,725.

It has been proposed to guide, in a suspended manner, load-carrying frames or conveyor containers constructed to receive hot material by means of rollers running on rails secured to the roof of the oven in the interior thereof. For this purpose, each load-carrying frame is provided with suspension members which carry rollers on transverse pins. The forward motion of the load-carrying frames through the hot chambers of the oven is effected in this previous proposal with the aid of a drive which comprises an endless chain on which a pair of spaced carriers is mounted. The carriers are so arranged that they engage one after another various transverse pins of the respective load-carrying frames when the chain is driven by means of a motor disposed outside the oven. On energizing the motor, the carrier engaging the load-carrying frame moves the frame forwardly because of the circulatory movement of the chain through the chamber, the second carrier of the pair displacing in a subsequent engagement the next load-carrying frame entering the next chamber, until the load-carrying frame is taken over by a carrier on the corresponding chain of the adjacent chamber.

This previously proposed conveyor system is disadvantageous in that the chain drive is complicated by the carriers mounted thereon, is costly and is liable to break down. Because of contamination caused by the oven atmosphere, the prior conveyor system runs badly, and cleaning and repair are only possible after emptying and cooling down of the oven have been undertaken. Moreover, a separate regulation device with control rods or the like must be provided and such an arrangement is complicated and is liable to break down.

SUMMARY OF THE INVENTION

One object of the present invention is to simplify the conveyor arrangement of the hereinbefore described kind with regard to the drive of the load-carrying frame through the oven.

Another object of the invention is to provide a conveyor arrangement for use in the arduous environment of an oven which is less liable to break down than those of previous proposals.

According to the present invention, there is provided in a conveyor apparatus for load-carrying frames through an oven, rail means, a load-carrying frame including rollers adapted to run on the rail means with the frame suspended thereby, and means for driving the load-carrying frame through the oven while suspended from the rail means, said driving means preferably including a rack secured to the load-carrying frame and preferably including a drive pinion drivingly mounted on the oven casing and arranged for meshing engagement with the rack whereby to advance the load-carrying frame through the oven, and motor means disposed externally of the oven and coupled to said drive pinion.

By means of this construction, the hitherto proposed complicated chain system is replaced by a rack and pinion drive which is constructionally simple, which is not liable to fail as a result of contamination caused by the oven atmosphere and which can readily be maintained externally of the oven since the rack is secured to the load-carrying frame. The drive pinion itself is likewise technically robust and, in comparison with a chain drive, is substantially easier to service or exchange. An additional decisive advantage is that no adjustment is necessary since, at the instant of de-energizing the motor in any position, a further forward movement or reverse movement of the load-carrying frame is not possible because the drive pinion meshes positively with the rack.

In order to simplify the introduction of the load-carrying frame and the coupling with the drive, it is proposed in a preferred construction of the invention to mount the drive pinion pivotally and to spring load the pinion toward the oven casing into a retracted position, the teeth being formed as spur gear teeth. In this way, both simple manufacture with highest possible certainty of operation and robustness is insured as also is positive engagement of the elements of the drive with one another. Other positive drive devices such as, for example, a worm drive can be used in place of the pivotal pinion drive.

As a rule, only one drive is sufficient for each oven chamber. In order, however, to enable the bridging of a door zone between chambers, it is preferable to provide an additional power-driven gear wheel spaced from the pinion and adapted to engage the rack. In the forward drive direction, the drive pinion initially draws the oncoming load-carrying frame forwardly into the oven chamber. Subsequently, with engagement of the second gear wheel, the frame is passed through the oven chamber and into the next oven chamber. For this purpose, both gear wheels can be arranged at the ends of a pivotally mounted support arm and connected by a chain passing over a tensioning roller. The chain is preferably arranged on the other side of the support arm in relation to the drive pinion and the gear wheel.

With this construction of the drive, the pivotal mounting of the carrier arm can be manufactured in the form of two parallel lever arms which are linked at one end to the carrier arm and at the other end to a plate secured to the oven casing which preferably is arranged in the same vertical plane as the support arm. The plate can be constructed for mounting of drive wheels which transmit the rotational movement of the motor shaft to the drive pinion.

In order to limit the pivotal range of the drive pinion or, as appropriate, the support arm in a simple manner and also to load these in the direction toward the rack, according to a preferred construction of the invention, there is preferably provided an upstanding tongue or other projection. This is secured to the drive pinion or the support arm on the one hand together with the plate or the casing on the other hand. The tongue carries a tension spring and also carries a tensioning roller for the chain.

In connection with the rack and pinion drive, it is possible and preferable to convey the load-carrying frame through the oven on only a single rail suspended from the oven roof and thus the load-carrying frame is provided with a series of rollers centered only in the longitudinal direction, and in particular four rollers. For improvement of the guidance, both the rail and rollers can be of roof-section or V-section. The rack can be secured simply to the roller mounting.

A substantially complete protection of the drive against contamination from the oven is possible. To this end, a complete enclosure is effected by means of a sheet metal casing which is provided only underneath with a longitudinal slot to enable the free longitudinal movement of the support arm connecting the carrying frame by means of rollers. A protective metal sheet is secured to the carrying arms of the load-carrying frame and covers the slot when the load-carrying frame is fully introduced into the oven chamber. By this means, any contamination of the drive is avoided.

It is to be noted that several drives in accordance with the invention can be provided one after another in one oven, and drivingly interconnected if appropriate with a common drive, if this is constructed for the simultaneous receipt of several adjacent suspended frames.

These and other objects and advantages of the invention will become more apparent from the following detailed description when taken in conjunction with the accompanying drawings.

DETAILED DESCRIPTION OF THE PREFERRED EMBODIMENT

Figure 1:
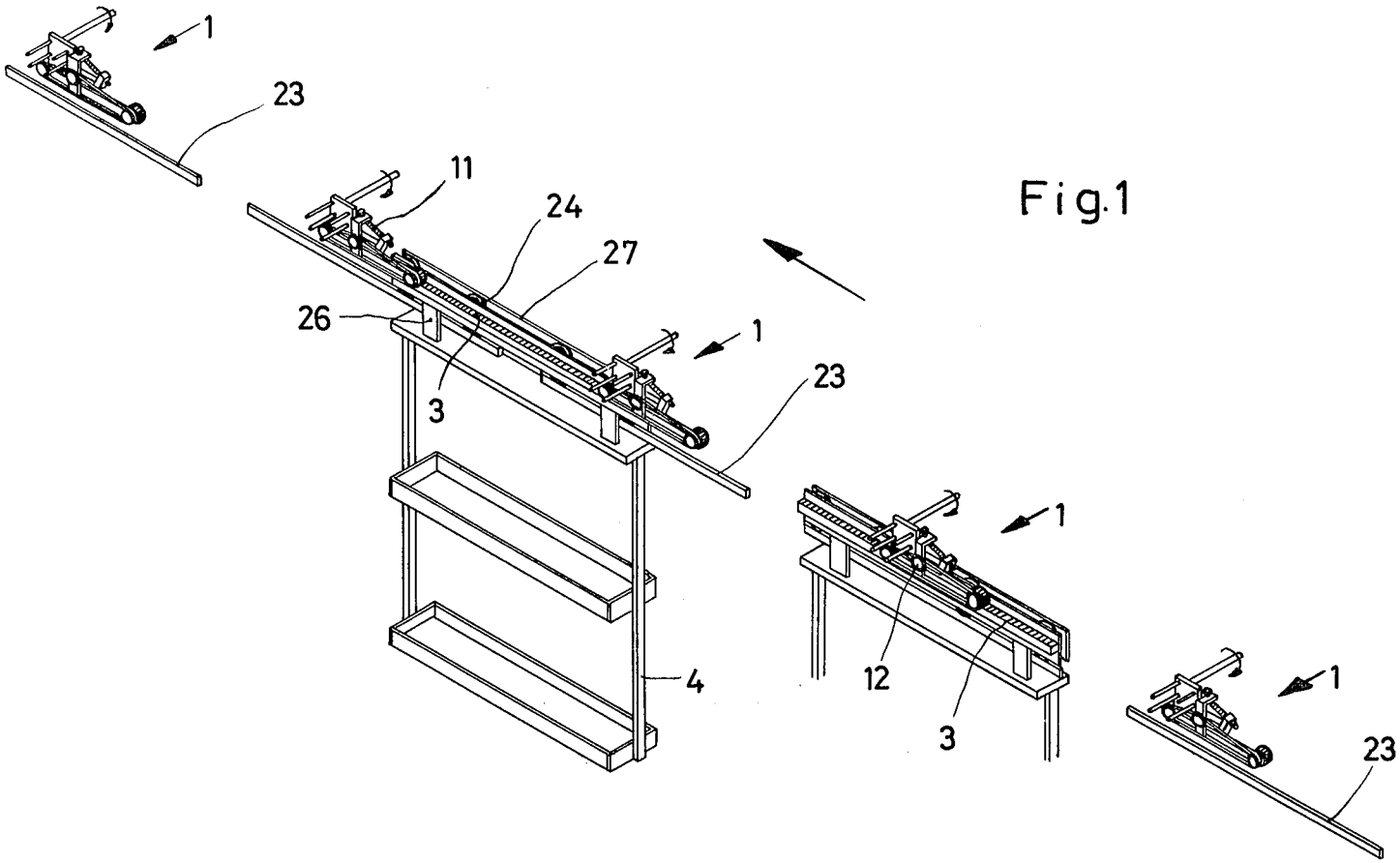
FIG. 1 is a perspective view of a conveyor apparatus for incorporation in a multiple-chamber, aluminum soldering, vacuum oven, certain parts of the oven being omitted.

The illustrated embodiment of a conveyor apparatus for load-carrying frames is intended for incorporation in a multi-chamber, aluminum soldering vacuum oven. The various chambers of the oven are not illustrated in the drawing. It is generally indicated in FIG. 1, however, that four different treatment chambers are provided, which chambers are separated from one another by vacuum-tight doors or locks. A rail 23 is mounted in each chamber. Load-carrying frames 4 are movable along the rails and through the respective chambers of the oven on rollers 24 by means of drive arrangements 1 in the chambers.

Each load-carrying frame 4 has a framework, to which two upstanding support members 26 are secured in spaced relation to one another. The members 26 are mounted on a traversing tolley 27 extending over the whole length of the load-carrying frame 4, and on which the rollers 24 are mounted. Details of the mounting and guidance of the load-carrying frame 4 will become apparent from FIG. 4.

Figure 4:
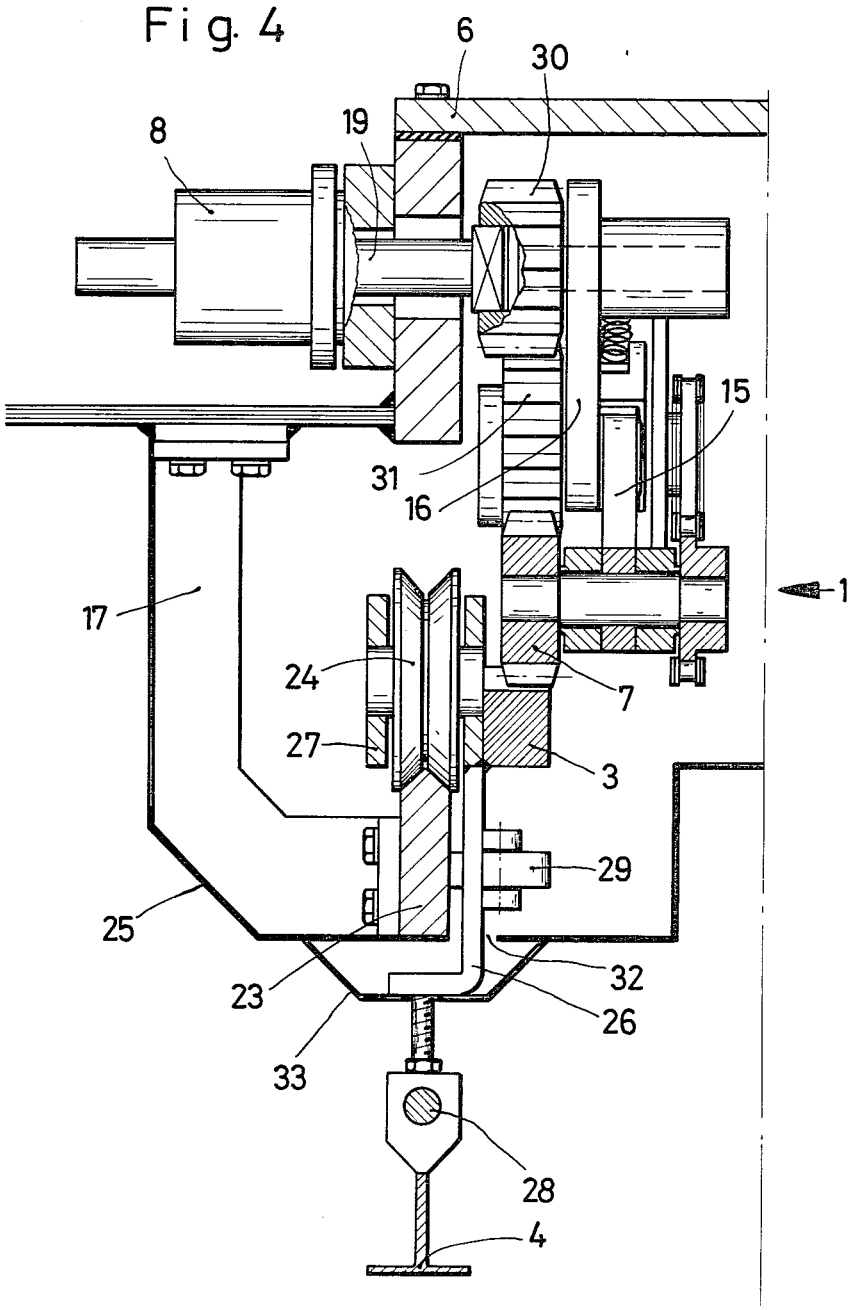
FIG. 4 shows the conveyor apparatus in cross-section.

Each support member 26 is pivoted through a pivot pin 28 with one load-carrying frame 4, of which in FIG. 4 only the uppermost part is indicated, and is secured to each support member 26 beneath the trolley 27 by means of a guide roller 29 which insures precise lateral guidance by rolling along on one lateral flank of the rail 23. The trolley 27 consists of two parallel, spaced plates which carry between them four rollers 24 mounted on pins. The rollers 24 are constructed with a V-shaped periphery in cross-section complementary to the profile of the running surface of the rail 23, so that both a good guidance along the length of the rail is provided and also a self-cleaning action is insured.

From FIGS. 1 and 4, it is readily apparent that a toothed rack 3 is secured to one of the plates of the trolley 27. Through spur teeth 5, the rack 3 meshes with a drive pinion 7 of the drive generally denoted 1. The pinion is mounted rotatably on a pivotal lever arm 15. Details of the mounting will be explained in conjunction with the description of FIGS. 2 and 3. The drive pinion 7 is driven by a motor mounted externally of the oven casing 6 through a drive shaft 19, an inner gear wheel 30 and an idler 31, which is rotatably mounted on a plate 16 secured to the oven casing 6.

The whole drive 1, consisting essentially of the rack and pinion drive 2, of which the rack 3 is secured to the load-carrying frame 4 and of which the teeth 5 engage the drive pinion 7 mounted by the plate 16 on the oven casing 6, is protected by a sheet metal cover 25 in relation to the interior of the oven. A longitudinal slot 32 enabling longitudinal movement along the sheet metal cover 25 is closed off substantially by a protective sheet metal member 33 which is secured to an L-shaped support member 26 of the load-carrying frame 4. By this means, there is avoided the contamination of the drive, arising during the treatment of the workpieces in the oven, for example a contamination by magnesium released under vacuum during the soldering process in an aluminum soldering oven.

Figure 2:
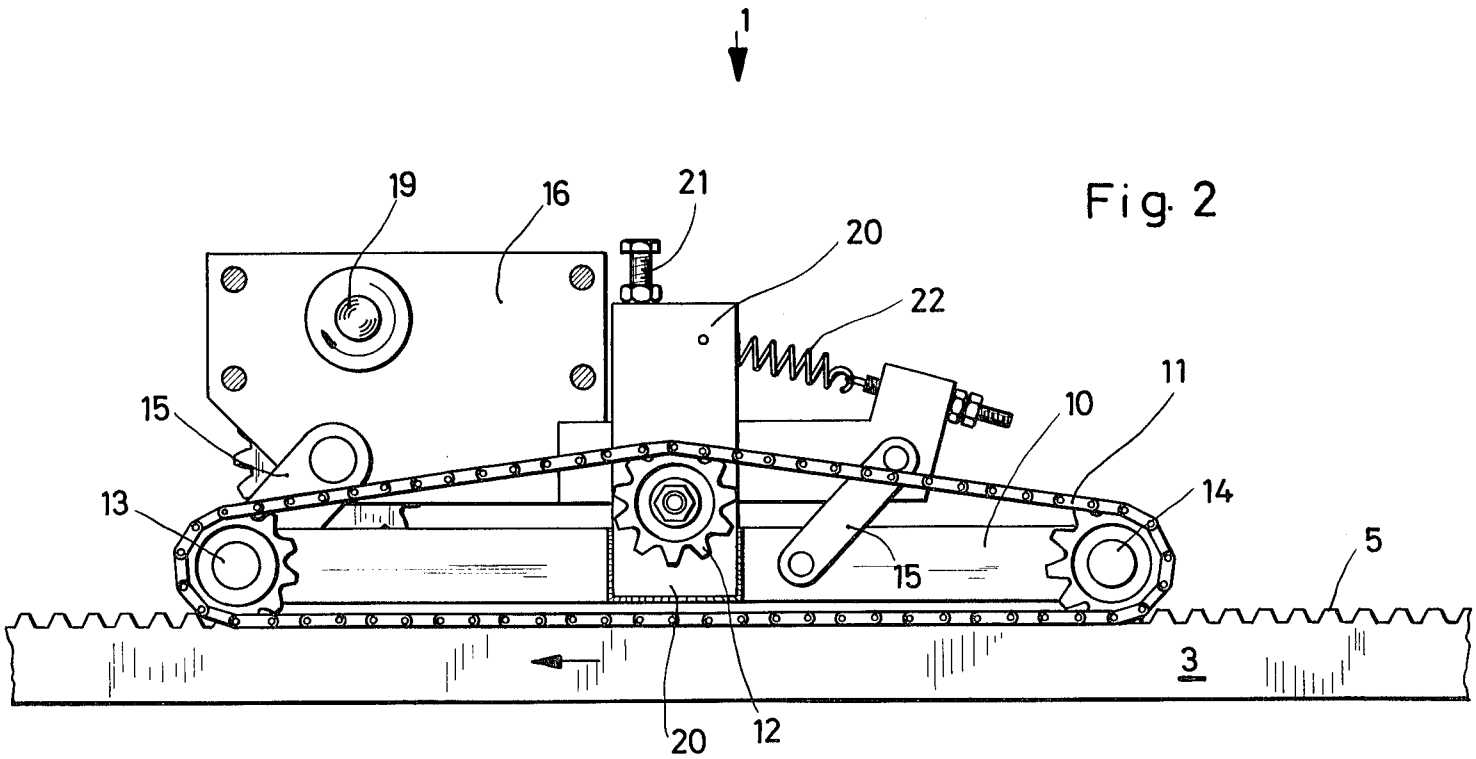
FIG. 2 is an enlarged side view of the conveyor apparatus of FIG. 1.
Figure 3:
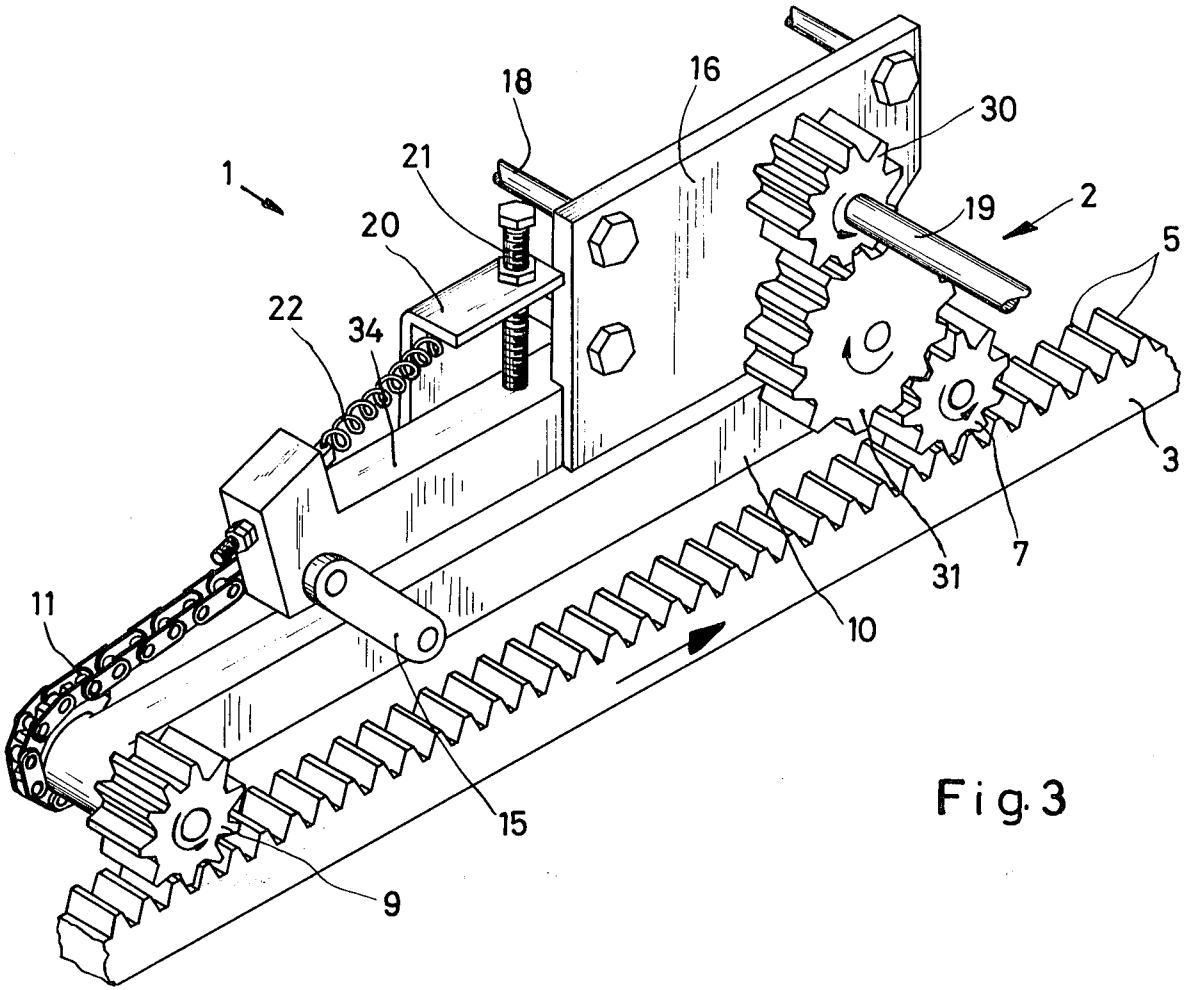
FIG. 3 is a rear perspective view of part of the conveyor apparatus.

The detailed construction of the drive 2 is made apparent from FIGS. 2 and 3. An illustration, to an enlarged scale, of the rack 3 secured to the load-carrying frame is apparent, with which the drive pinion 7 (see FIG. 3) meshes. The idler 31 meshes with the drive pinion 7 and again the gear wheel 30 is drivingly coupled therewith, which is driven by the shaft 19. The last-mentioned gear wheels are rotatably mounted on the plate 16.

In order to provide the capability of pivoting of the drive pinion 7 and moreover to insure the capability of travel of the load-carrying frame even in the bridging zone of the locks (not shown) between the individual chambers of the oven, a support arm 10 is pivotally linked beneath the plate 16 on two parallel pivotal arms 15, each of which is rotatable in a bearing bush at its one end on the axis of the drive pinion 7 and at the other end carries a further gear wheel 9. The gear wheel 9 is positively driven through a chain drive when the motor shaft 19 is driven. The chain drive is arranged on the other side of the plate 16 and is best illustrated in FIG. 2.

The drive pinion 7 and the gear wheel 9 lie at opposite ends of the arm 10 and are mounted on the same pins as the chain sprocket wheels 13 and 14 which are connected with one another by an endless chain 11, a tensioning wheel 12 being provided to maintain chain tension. The tensioning wheel 12 is rotatably mounted on a tongue or other upstanding projection 20, which is welded to the support arm 10 and is bent over at right angles at its upper, free end (see FIG. 3). The bent-over portion overlies an arm 34 of the plate 16 and carries an adjustable stop screw 21, of which the adjustment determines the position of the support arm 10. Between the bent over portion of the tongue 20 and an upstanding projection of the arm 34 a tension spring 22 is provided, which exerts a force acting downwardly towards the rack. Thus it is possible to provide adjustment for various load-carrying frame constructions, and in spite of the pivotal capability of the drive pinion, it is insured that the teeth of the rack mesh with the pinion.

If a load-carrying frame 4 is delivered to the first oven chamber in the direction of conveyance according to the arrow shown on the rack 3, the frame rolls in a suspended manner with its four rollers 24 on the rail 23, which is secured to the oven casing 6 by means of generally L-shaped rail supports 17. Lateral guidance is effected by the guide roller 29.

When the rack 3 of any load-carrying frame 4 encounters the gear wheel 9, this is pivoted upwardly together with the drive pinion 7 as well as the carrying arm 10 on the parallel lever arms 15, and brought into engagement with the teeth. The tension spring 22 presses for this purpose the support arm downwardly with the aid of the tongue 20.

By means of the motor drive through the motor shaft 19 and the rack-and-pinion drive 2, the load-carrying frame 4 is drawn into the first oven chamber. If it is in the correct treatment position, the motor is switched off and the arrest of the load-carrying frame is effected automatically through the rack and pinion drive 2 against any further forwards or rearwards motion.

After effecting the required treatment, the load-carrying frame is moved out of the oven chamber by the rack and pinion drive, during which both the drive pinion 7 and also the gear wheel 9 are operative. Later, in the transfer zones of the locks between adjacent chambers, however, only the drive pinion 7 in engagement with the rack 3 and the load-carrying frame is thus moved forward again until the gear wheel 9 of the conveying apparatus of the next oven chamber comes into meshing engagement with the rack. With very lengthy oven chambers, several such conveyor arrangements can be provided, as in particular is apparent from FIG. 1 of the drawing.

Further, it is possible in continuous ovens to make possible the parallel treatment of two or more series of load-carrying frames, so that two or more of the hereinbefore described conveyor arrangements are arranged parallel to one another and driven by a single motor.

In place of spur gear teeth in connection with the pivotal drive pinion, other positive drive devices such as, for example, a worm drive can be used in place of the pivotal pinion drive.

The essential advantage of the described drive consists in that any dirt contamination liable to adversely affect smooth running is rendered substantially impossible, a safe and reliable drive over a long period is insured by the use of a rack and pinion drive instead of a chain drive, and finally easy cleaning and maintenance of the conveyor arrangement is made possible, so that overall a very compact drive unit is suspended only on four bolts 18 of the plate 16 and it follows from this that it is simple to construct and to exchange when necessary.

By means of the hereinbefore described embodiment, the complicated chain system of previous proposals is replaced by a rack and pinion drive, which is constructionally simple, not liable to fail as a result of contamination and, since the rack is secured to the load-carrying frame, can readily be maintained externally of the oven. The drive pinion itself is likewise technically robust and in comparison with a chain drive substantially easier to service or exchange. A decisive advantage is moreover that no location adjustment is necessary since, at the instance of switching off of the motor in any position, a further forward movement or reverse movement of the load-carrying frame is not possible because the drive pinion meshes with the rack.

We claim:

1. Apparatus for conveying a load-carrying frame through an oven casing, said apparatus comprising rail means disposed within the oven casing, said frame comprising rollers adapted to run on said rail means with the frame suspended thereby, means for driving said frame through the oven casing while suspended from said rail means, said driving means comprising a first gear member secured to said frame, a second gear member rotatably supported on the oven casing and adapted to mesh with said first gear member to advance said frame through the oven casing, and motor means disposed externally of the oven casing and connected to rotate said second gear member.

2. Apparatus according to claim 1, in which said first gear member comprises a rack secured to said frame, said second gear member comprising a drive pinion coupled to said motor means.

3. Apparatus according to claim 2, further comprising spring means loading said drive pinion toward engagement with said rack.

4. Apparatus according to claim 2, further comprising an additional gear wheel arranged for meshing engagement with said rack and spaced from said drive pinion so that said rack can be driven in dependence upon relative location either by both the additional gear wheel and the drive pinion or by one of them only.

5. Apparatus according to claim 4, comprising a pivotally mounted support arm carrying the drive pinion and the additional gear wheel at respective ends thereof, a chain coupling the drive pinion and the additional gear wheel, and a tensioning roller over which the chain passes.

6. Apparatus according to claim 5, comprising chain-mounting sprocket wheels, the chain being mounted on the other side of the support arm in relation to the drive pinion and the additional gear wheel, and the sprocket wheels being co-axial with the drive pinion and the additional gear wheel, respectively.

7. Apparatus according to claim 3, comprising a support arm carrying said drive pinion, a two-armed parallelogram linkage, and a plate fixed with respect to the oven casing and disposed in a common vertical plane with that of the support arm, said linkage being linked at one end to the support arm and at the other end to said plate.

8. Apparatus according to claim 7, comprising further gear wheels in addition to said drive pinion, the plate also mounting said further gear wheels.

9. Apparatus according to claim 5, comprising an upstanding projection on said support arm, and an adjustable limit stop, said limit stop serving to limit pivotal movement of the drive pinion.

10. Apparatus according to claim 9, comprising a spring loading the upstanding projection in a direction to cause meshing engagement of the pinion with the rack.

11. Apparatus according to claim 1, wherein the rail means comprise only a single rail arranged to be suspended from the oven casing, and the load-carrying frame is provided with a plurality of rollers which enable movement along said single rail.

12. Apparatus according to claim 11, wherein the rail and the rollers are constructed to have a V-shape profile of complementary form.

13. Apparatus according to claim 1, comprising a sheet metal cover to provide protection to the drive means in relation to the interior of the oven.

14. A continuous oven comprising a casing divided into chambers, a motor mounted externally of the casing, rail means mounted on the casing in each chamber, a load-carrying frame having rollers, said rollers serving to suspend the frame from the rail means during passage through successive chambers, a rack secured to said frame, drive means mounted on the inside of the casing in each chamber and coupled to the motor, said drive means including a pinion, a further gear wheel, a chain drive drivingly connecting the pinion and the further gear wheel, means biasing the pinion and the further gear wheel in a direction towards the path of the rack through the chamber, said pinion and further gear wheel serving to advance the rack and load-carrying frame through the chamber, one or both of said pinion and said wheel being in meshing engagement with the rack in dependence on the location of the frame in the chamber.

* * * * *